US006179965B1

(12) United States Patent
Cunnane, III et al.

(10) Patent No.: US 6,179,965 B1
(45) **Date of Patent: *Jan. 30, 2001**

(54) PAPERMAKERS WET PRESS FELT WITH HIGH CONTACT, RESILIENT BASE FABRIC

(75) Inventors: Francis J. Cunnane, III, Greer; H. Thomas Sanders, Isle of Palms, both of SC (US)

(73) Assignee: AstenJohnson, Inc., Charleston, SC (US)

( * ) Notice: Under 35 U.S.C. 154(b), the term of this patent shall be extended for 0 days.

This patent is subject to a terminal disclaimer.

(21) Appl. No.: 08/342,827

(22) Filed: Nov. 21, 1994

Related U.S. Application Data

(63) Continuation of application No. 07/955,513, filed on Oct. 2, 1992, now Pat. No. 5,368,696.

(51) Int. Cl.[7] ..... D21F 7/08

(52) U.S. Cl. ..... 162/358.2; 139/383 A; 162/900; 442/270; 428/398

(58) Field of Search ..... 162/358.1, 358.2, 162/900; 428/229, 234, 398; 139/383 A; 442/270

(56) References Cited

U.S. PATENT DOCUMENTS

| | | | |
|---|---|---|---|
| 2,132,252 | 10/1938 | Weber . | |
| 4,107,367 | 8/1978 | Fekete | 428/234 |
| 4,142,557 | 3/1979 | Kositzke | 139/425 |
| 4,251,588 | 2/1981 | Goetemann et al. | 428/224 |
| 4,259,394 | 3/1981 | Khan | 428/229 |
| 4,290,209 | 9/1981 | Buchanan et al. | 139/383 |
| 4,351,874 | 9/1982 | Kirby | 428/229 |
| 4,379,735 | 4/1983 | MacBean | 162/348 |
| 4,414,263 | 11/1983 | Miller et al. | 428/234 |
| 4,461,803 * | 7/1984 | Booth et al. | 162/900 |
| 4,537,816 | 8/1985 | Booth et al. | 428/234 |
| 4,569,883 | 2/1986 | Renjilian | 428/234 |
| 4,883,097 * | 11/1989 | Dufour | 139/383 |
| 5,094,719 * | 3/1992 | Fry | 162/900 |

FOREIGN PATENT DOCUMENTS

790861 * 9/1980 (FI) .

OTHER PUBLICATIONS

Specification Sheet of Antron Yarns Available from DuPont.

* cited by examiner

*Primary Examiner*—Karen M. Hastings
(74) *Attorney, Agent, or Firm*—Volpe & Koenig, PC

(57) ABSTRACT

Hollow synthetic monofilament yarns are used in the construction of a base fabric for a papermakers wet felt. The synthetic hollow monofilament yarns have selected interior void, compressibility and resiliency characteristics and are interwoven with other yarns to form a woven base fabric with the hollow monofilament yarns predominating, on at least the paper carrying side of the base fabric. The weaving and finishing of the base fabric results in the hollow monofilament yarns retaining a substantially unflattened cross-section. Accordingly, substantially unflattened portions of the hollow monofilament yarns predominate the paper carrying side of the base fabric thereby providing a cushioning surface which is compressibly resilient to assist in the dewatering of the aqueous paper web as it is transported through a press nip during the manufacture of the paper. Hollow nylon monofilament yarns having approximately 18% internal core void have been found to exhibit the desired compressibility and resiliency characteristics. Preferably a fibrous batt is needled to the base fabric to finish the wet press felt.

9 Claims, 1 Drawing Sheet

PAPERMAKERS WET PRESS FELT WITH HIGH CONTACT, RESILIENT BASE FABRIC

This is a continuation of application Ser. No. 07/955,513, filed on Oct. 2, 1992, now U.S. Pat. No. 5,368,696.

This invention relates to papermakers fabrics and, in particular, to wet press felts for use in the press section of a papermaking machine.

BACKGROUND OF THE INVENTION

Wet press felts are used in the press section of papermaking machines to transport and dewater an aqueous paper web which is being made into a desired paper product. The dewatering process conventionally entails transporting the aqueous web through a series of pressure nips.

It is well known in the art to employ press felts comprised of a base fabric with fibrous batt material needled thereto. The fibrous batt generally provides a smooth paper carrying surface and a resilient structure to assist in the dewatering of the aqueous paper web. Any irregularities in the wet felt can result in undesirable marking of the aqueous paper web since it is highly deformable at this stage of the papermaking process.

A wide variety of base fabric constructions are known in the art. For example, the base fabric may be comprised of a single layer or multiple layers of machine direction yarns, having a relatively large diameter to provide machine direction strength, interwoven with smaller diameter cross machine direction yarns.

Even though the base fabric is covered with batt material, the yarns which predominate the paper carrying side of the base fabric can cause marking on the aqueous paper web. In particular, the yarns which predominate on the paper carrying side of the base fabric can lead to problems with marking of the aqueous sheet. Such problems may not be initially apparent. However, they can occur after the fabric has been used on papermaking equipment since the batt materials becomes matted and/or compacted through use. This tends to augment the effect of the base fabric on the aqueous web.

Additionally, base fabrics have been designed to enhance the overall resiliency of the press felt to assist in the dewatering process. U.S. Pat. No. 4,537,816, assigned to the assignee of the present invention, discloses a wet felt having a selectively configured base fabric structure which is designed with void areas to enhance the resiliency and dewatering ability of the wet felt.

Another example of a base fabric designed to enhance the overall resiliency of press felt is disclosed in U.S. Pat. No. 4,883,097, assigned to the assignee of the present invention, wherein a compressible, resilient knit yarn is incorporated into the weave of the base fabric structure.

Additionally, U.S. Pat. No. 4,414,263, discloses the use of flat cross machine direction (CMD) yarns to decrease the prominence of CMD yarn knuckles in the base fabric of a wet press felt to avoid problems with marking.

Hollow synthetic monofilament yarns are known in the papermaking arts. Such yarns are disclosed in U.S. Pat. No. 4,251,588, for the manufacturer of a dryer fabric having improved dimensional stability. As noted therein, such conventional, hollow monofilament yarns have a core void of about 3% to 15% of their cross-sectional area to avoid flattening.

In the context of a dryer fabric application, applicant's assignee has experimented with using hollow monofilament yarns having a core void in excess of 30%. In such application, the wall thickness of the yarns is designed to become flattened in the weave to reduce the permeability of the dryer fabric.

Other uses of hollow yarns are known in the art. For example, U.S. Pat. No. 2,132,252, discloses the use of hollows metal wires in the creation of a forming fabric. However, such forming fabrics are not subjected to pressure nips and accordingly do not demand the resiliency of a press fabric. Additionally, U.S. Pat. No. 4,569,883, employs hollow fibers in the composition of spun yarns and/or to comprise the fibrous batt material for a wet press felt.

SUMMARY OF THE INVENTION

Present invention employs the use of hollow synthetic monofilament yarns in the construction of a base fabric for a papermakers wet press felt. The synthetic hollow monofilament yarns have selected compressibility and resiliency characteristics.

The hollow monofilament yarns are interwoven with other yarns to form a woven base fabric with the hollow monofilament yarns predominating, such as by defining CMD knuckles or floats, oil at least the paper carrying side of the base fabric. The weaving and finishing of the base fabric results in the hollow monofilament yarns retaining a substantially unflattened cross-section Accordingly, substantially unflattened portions of the hollow monofilament yarns predominate the paper carrying side of the base fabric thereby providing-a cushioning surface which is compressibly resilient to assist in the dewatering of the aqueous paper web as it is transported through a press nip during the manufacture of the paper.

In the preferred embodiment, the weaving and heat setting of the base fabric results in the hollow monofilament yarns varying in dimension from a substantially round cross-section to a partially flattened cross-section. Partial flattening occurs at the contact areas between the crossovers where warp and weft yarns interweave, such as at base fabric knuckles. Accordingly, partially flattened portions of the hollow monofilament yarns increase the contact area of the paper carrying side of the base fabric.

As the press felt carries an aqueous paper web through a press nip of a papermaking machine, the hollow monofilament yarns which predominate the paper carrying side of the base fabric become fully flattened within the nip. Accordingly, the base fabric's paper carrying surface exhibits a contact area significantly higher than fabrics which use conventional round monofilament cross machine direction yarns. Additionally, due to the resiliency of the hollow monofilament yarns, improved dewatering and avoidance of rewetting of the web is exhibited as the base fabric is compressed within the nip and rebounds as it exits the nip.

It is possible to use flat cross machine direction yarns to achieve a high contact area on the paper carrying side of the base fabric. However, such flat monofilament yarns do not exhibit the improved dewatering and avoidance of rewetting, since they lack resiliency. Additionally, flat yarns are problematic in weaving and are extremely difficult to bobbin rewind without twisting.

The hollow monofilament yarn is easily bobbin wound and woven in the same manner as conventional round yarns of similar diameter. The wet press felt is preferably woven endless such that the hollow monofilament cross machine direction yarns are warp yarns in the loom and are in the cross machine direction in use. However, the hollow monofilament yarns weave equally well as weft yarns which are thrown by a shuttle during weaving.

Preferably, hollow monofilament CMD yarns are interwoven with one or more layers of multifilament, twisted monofilament and/or monofilament nylon MD yarns to define the base fabric. Hollow nylon monofilament yarns having approximately 16%–25% internal core void have been found to exhibit the desired compressibility and resiliency characteristics.

Preferably a fibrous batt is needled to the base fabric to finish the wet press felt.

It is an object of the present invention to provide an improved wet press felt through the combination of enlarging the contact area of the yarns which predominate on the paper carrying side of the base fabric in the nip while increasing the resiliency of the base fabric.

Other objects and advantages of the present invention will become apparent from the following description of a presently preferred embodiment.

DETAILED DESCRIPTION OF A PREFERRED EMBODIMENT

Figure 1:
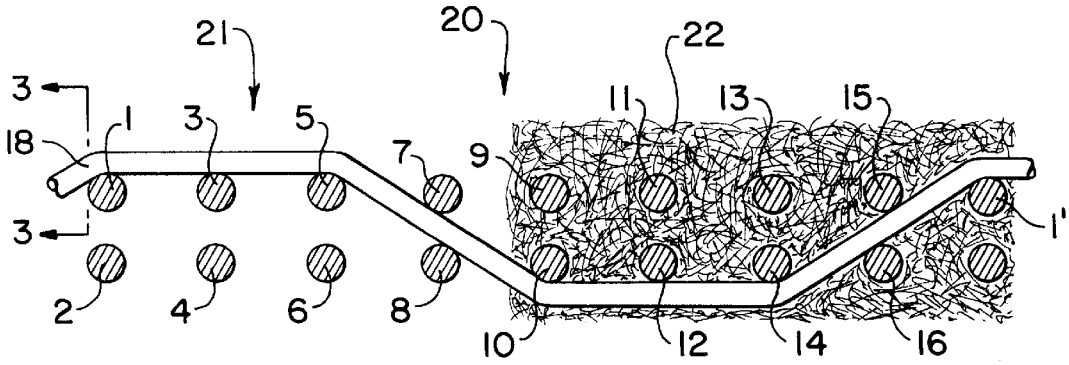
FIG. 1 is a schematic diagram of a cross section of a wet press felt made in accordance with the teachings of the present invention, only a portion of the felt's batt being shown for clarity.

Referring to FIG. 1, there is shown a schematic diagram of a preferred embodiment of a wet press felt made in accordance with the teachings of the present invention. The press felt 20 comprises a base fabric 21 to which a batt 22 is needled.

The base fabric 21 is comprised of a repeat of sixteen (16) machine direction (MD) yarns 1–16, interwoven with the an eight shed repeat system of cross machine direction (CMD) yarns 18 to define a woven fabric having two layers of machine direction yarns and a paper carrying side predominated by the CMD yarns. For clarity, only one CMD yarn 18 is shown in FIG. 1.

The first CMD yarn of the eight shed CMD yarn repeat weaves over MD yarns 1–6, between MD yarns 7, 8, under MD yarns 9–14, between MD yarns 15, 16, and thereafter repeats. Accordingly, the first CMD yarns 18 define a three yarn float on the paper carrying side of the base fabric 21 by floating over top layer MD yarns 1, 3, 5. The second CMD yarn in the CMD repeat (not shown), similarly weaves a three yarn float over top layer MD yarns 9, 11, 13. The third CMD yarn of the CMD repeat (not shown), similarly weaves a three yarn float on the top layer over MD yarns 3, 5, 7. The fourth CMD yarn of the CMD repeat (not shown), similarly weaves a three yarn float over top layer MD yarns 11, 13, 15. The fifth CMD yarn of the CMD repeat (not shown), similarly weaves a three yarn float over top layer MD yarns 7, 9, 11. The sixth CMD yarn of the CMD repeat (not shown), similarly weaves a three yarn float over top layer MD yarns 15, 1, 3. The seventh CMD yarn of the CMD repeat (not shown), similarly weaves a three yarn float over top layer MD yarns 5, 7, 9. The eighth CMD yarn of the CMD repeat (not shown), similarly weaves a three yarn float over top layer MD yarns 13, 15, 1. Accordingly, CMD yarn floats predominate the surface of the paper carrying side of the base fabric. Similarly, in the preferred embodiment, the CMD yarns also predominate the machine side of the base fabric.

Figure 2:
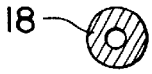
FIG. 2 is a cross section of the cross machine direction yarns used in the base fabric of the felt depicted in FIG. 1.

In one example, the MD yarns 1–16 are twisted monofilament nylon yarns comprised of three twisted pairs of 0.008 inch diameter nylon strands. The CMD yarns 18 are hollow monofilament yarns 0.016 inches in diameter with an internal core void of 18% having an O-shaped cross-section as shown in FIG. 2. The base fabric is woven endless with each layer of MD yarns woven 23 picks per inch, which totals 46 MD yarns per inch for the two layers, and the CMD yarns woven 30 ends per inch resulting in a base fabric having a weight of approximately 2.06 ounces per square foot. The base fabric is heat set at 340° F. at a constant, tension of 40 pounds per linear inch. In finishing the fabric, 15 denier fibrous batt material is needled onto the paper carrying side of the fabric 1.80–2.50 ounces per square foot.

Figure 4:
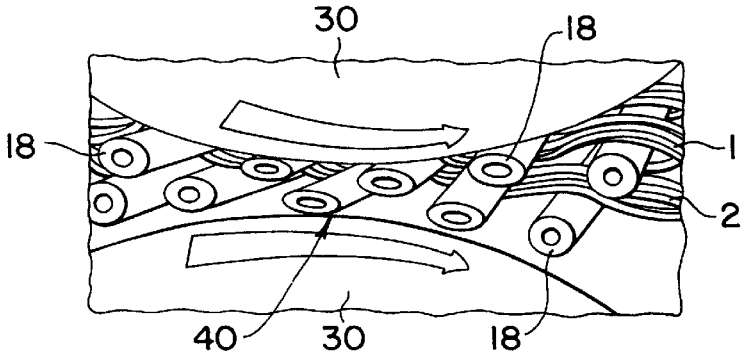
FIG. 4 is a schematic diagram illustrating the compressibility and resiliency of the base fabric of the wet press felt shown in FIG. 1 as it travels through a press nip, the felt's batt and the aqueous paper web are not shown for clarity.

The hollow monofilament CMD yarns are selected for their compressibility and resiliency characteristics such that the entirety of the yarns remains substantially unflattened through the weaving and finishing processes, but become fully flattened when subjected to nip pressures of 200 psi (pounds per square inch) or more. Such pressure is applied by press rollers 30 within a nip 40, as illustrated in FIG. 4. The resiliency of the hollow yarns 18 is such that they are capable of rebounding to their uncompressed state after being subjected to nip pressures of the papermaking press machines.

Hollow, nylon yarns having a core void from 16% to 25% exhibit these characteristics. If the core void is too low, the yarns are not sufficiently compressible. If the core void is too high, the yarns become flattened in weaving and are not resilient.

Figure 3:
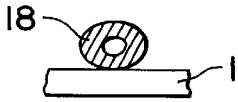
FIG. 3 is a partial cross section of the base fabric of the felt shown in FIG. 1 taken along line 3—3.

In the preferred embodiment, the weaving and heat setting of the base fabric causes portions of CMD yarns 18 to become deformed from their initial round cross section, shown in FIG. 2, to a partially flattened cross section. This occurs where the CMD yarns are in interweaving contact with the MD yarns. For example, as shown in FIG. 3, partial flattening occurs where CMD yarn 18 weaves about MD yarn 1.

The partial flattening of the CMD yarns increases the contact area of the paper carrying side during the manufacture of the press felt in contrast to a similarly made felt employing solid round monofilament yarns. Moreover, when the finished felt is used in the papermaking process to transport an aqueous paper web through a press nip, the contact area of the paper carrying side of the base fabric significantly increases in the nip due to the full flattening of the CMD yarns under the nip pressures. As illustrated in FIG. 4, as the felt travels out of the nip 40, the resiliency of the CMD yarns 18 enhances the ability of the base fabric to rebound to its uncompressed state thereby avoiding rewetting of the sheet as it exits the nip.

The compressibility and the resiliency of the yarns which predominate the paper carrying side of the base fabric is also beneficial in prolonging the life of the fabric. The hollow monofilament yarns serve to cushion the intersection of the MD and CMD yarns when they are exposed to nip pressures. In contrast, even in fabrics which utilize solid flat CMD yarns, the contact between the solid CMD yarns with the MD yarns causes wear of the base fabric and compaction of the felt.

The incorporation of hollow monofilament yarns having such selected compressibility and resiliency characteristics provides the high contact area benefits seen with the use of flat CMD yarns without the associated weaving problems inherent with the use of flat yarns. Moreover, the high contact area of the paper carrying side of the base fabric exhibits a cushioning effect which does not occur when solid flat yarns are employed. This cushioning effect provides more uniform pressure on the sheet in the nip which translates into improved dewatering and high sheet consistencies.

The press felt exhibits superior compaction resistance and resistance to base weave collapse and cross over point yarn indentation. Heightened caliper retention in the felt retards felt hardening, improves vibration resistance, and provides cushion in the nip to dampen nonuniformities. Additionally, the use of the hollow monofilament yarns creates an inherently more flexible felt for easier installations.

As an alternative to a three float CMD weave, the CMD yarns may be woven with single knuckles which predominate the paper carrying side of the base fabric. In such instance, the partially flattened CMD knuckles predominate the surface of the paper carrying side of the base fabric. The use of monofilament CMD yarns having internal core void of between 15% to 25% avoids full flattening of such CMD knuckles in the weave, permits compression of the CMD yarn knuckles in the nip, and exhibits resiliency to allow the CMD yarn knuckles to rebound to their partially flattened state upon exit from the press nip.

While specific base fabric weave patterns have been described, other weave patterns and embodiments will be apparent to those of ordinary skill in the art as being within the scope of the present invention. Additionally, although batt material is preferably needled on one side of the base fabric, fibrous batt material can be needled to both sides of the base fabric in finishing the felt.

What we claim is:

1. A wet press felt comprising:

a woven base fabric having a paper carrying side; said base fabric including a first system of yarns interwoven with a second system of yarns;

said first system yarns being hollow, synthetic monofilament yarns having an O-shaped cross-section and an internal core void of at least 16%, being compressible from a substantially round cross-section to a fully flattened cross-section when subjected to nip pressures of at least 200 psi, and being sufficiently resilient to rebound to an uncompressed state after passing through a press nip; and said base fabric being woven and finished such that in said finished base fabric:

portions of said first system yarns which contact said second system yarns have at least a partially flattened cross-section, and said first system yarns remain substantially unflattened in cross-section thereby defining resiliently compressible cushioning for enhancing wet press felt performance in dewatering an aqueous paper web through a press nip.

2. A wet press felt according to claim 1 wherein said second system yarns are oriented in the machine direction (MD) of the base fabric and said first system yarns are oriented in the cross machine direction (CMD) of said base fabric.

3. A wet press felt according to claim 2 wherein said MD yarns are twisted monofilament nylon yarns, said CMD yarns are nylon yarns having an internal core void of approximately 18%, and said base fabric is woven such that said CMD yarns define three yarn floats on at least said paper carrying side of said base fabric.

4. A wet press felt according to claim 3 further characterized in that a fibrous batt is needled onto at least said paper carrying side of said base fabric.

5. A wet press felt according to claim 4 wherein said MD yarns are woven in two layers with a total of 46 MD yarns per inch and said CMD yarns are interwoven with both layers of MD yarns in an eight shed, 16 MD yarn repeat pattern 30 CMD yarns per inch.

6. A wet press felt according to claim 1 wherein said first system yarns are woven to define CMD yarn floats on said base fabric paper carrying side and are hollow monofilament yarns having an internal core void of approximately 18%.

7. A wet press felt according to claim 6 wherein said MD yarns are woven in two layers with a total of 46 MD yarns per inch and said CMD yarns are interwoven with both layers of MD yarns in an eight shed, 16 MD yarn repeat pattern 30 CMD yarns per inch.

8. A wet press felt according to claim 1 further characterized in that a fibrous batt is needled onto at least said paper carrying side of said base fabric.

9. A wet press felt according to claim 2 further characterized in that a fibrous batt is needled onto at least said paper carrying side of said base fabric.

* * * * *